US010654612B2

(12) United States Patent
Lee

(10) Patent No.: US 10,654,612 B2
(45) Date of Patent: May 19, 2020

(54) PACKAGING BOX

(71) Applicant: CJ Cheiljedang Corporation, Seoul (KR)

(72) Inventor: Byung Kook Lee, Seoul (KR)

(73) Assignee: CJ Cheiljedang Corporation, Seoul (KR)

( * ) Notice: Subject to any disclaimer, the term of this patent is extended or adjusted under 35 U.S.C. 154(b) by 0 days.

(21) Appl. No.: 15/529,829

(22) PCT Filed: Nov. 26, 2015

(86) PCT No.: PCT/KR2015/012793
§ 371 (c)(1),
(2) Date: Aug. 2, 2017

(87) PCT Pub. No.: WO2016/085274
PCT Pub. Date: Jun. 2, 2016

(65) Prior Publication Data

US 2017/0349321 A1 Dec. 7, 2017

(30) Foreign Application Priority Data

Nov. 27, 2014 (KR) ..... 20-2014-0008727 U

(51) Int. Cl.
*B65D 5/46* (2006.01)
*B65D 5/42* (2006.01)
(Continued)

(52) U.S. Cl.
CPC ..... *B65D 5/46008* (2013.01); *B65D 5/02* (2013.01); *B65D 5/10* (2013.01); *B65D 5/4266* (2013.01)

(58) Field of Classification Search
CPC .... B65D 5/46008; B65D 5/02; B65D 5/4266; B65D 5/46192; B65D 2571/0045;
(Continued)

(56) References Cited

U.S. PATENT DOCUMENTS 3,197,116 A * 7/1965 Zastrow ..... B65D 5/4608 229/117.13
3,794,239 A * 2/1974 Bonczyk ..... B65D 5/46192 229/117.13
(Continued)

FOREIGN PATENT DOCUMENTS

JP S49-013223 U 5/1972
JP S56-043776 U 4/1981
(Continued)

OTHER PUBLICATIONS

International Search Report dated Mar. 2, 2016, for International application No. PCT/KR2015/012793, 2 pages, English Translation.
(Continued)

*Primary Examiner* — Christopher R Demeree
(74) *Attorney, Agent, or Firm* — Adsero IP

(57) ABSTRACT

The present invention relates to a packaging box including: a main body having at least an upper surface and an inner space; and a handle disposed on the upper surface of the main body, wherein the upper surface is disposed to be dented inwardly so as to be apart from the handle. The packaging box has the folding line formed on the upper surface so as to make the upper surface dented inwardly by the user's pressing and make the upper surface and the handle spaced apart from each other such that the user can easily insert his or her finger therebetween, thereby remarkably improving user convenience. The packaging box sufficiently shields the inner space from the outside because the upper surface maintains sealing force when the upper surface is dented in order to form the finger insertion space, thereby effectively preventing the inflow of contaminants so as to maximize user satisfaction.

2 Claims, 3 Drawing Sheets

(51) Int. Cl.
*B65D 5/02* (2006.01)
*B65D 5/10* (2006.01)

(58) Field of Classification Search
CPC ..... B65D 2571/00444; B65D 5/46072; B65D 5/4608; B65D 2571/00456
USPC .... 229/117.09, 117.13, 199, 117.16, 117.23; 206/141, 200, 428
See application file for complete search history.

(56) References Cited

U.S. PATENT DOCUMENTS 4,057,950 A 11/1977 Focke
4,222,485 A * 9/1980 Focke ..... B65D 5/46192 206/141
4,418,864 A * 12/1983 Nielsen ..... B65D 5/46016 229/117.13
4,567,070 A * 1/1986 Karass ..... B65D 5/445 206/813
5,718,369 A 2/1998 Delisle et al.
5,878,946 A 3/1999 Frerot et al.
5,897,051 A * 4/1999 Tessier ..... B65D 71/02 229/117.13
5,915,546 A 6/1999 Harrelson
2004/0245286 A1 12/2004 Lee

FOREIGN PATENT DOCUMENTS

JP S57-001067 1/1982
JP S61-008561 U 1/1986
JP H01-047632 U 4/1993
JP H06-122440 5/1994
JP 2003-335323 A 11/2003
JP 2009-029447 2/2009
JP 5155039 B2 1/2010
KR 10-2013-0040668 A 7/2013

OTHER PUBLICATIONS

1st Office Action, dated Apr. 17, 2018, to Singapore Application No. 11201705454R, 7 pages.

* cited by examiner

【Fig. 1】
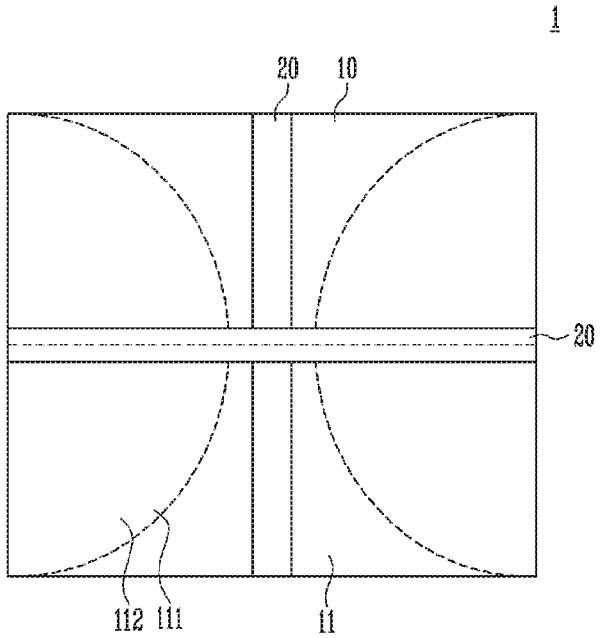
【Fig. 2】
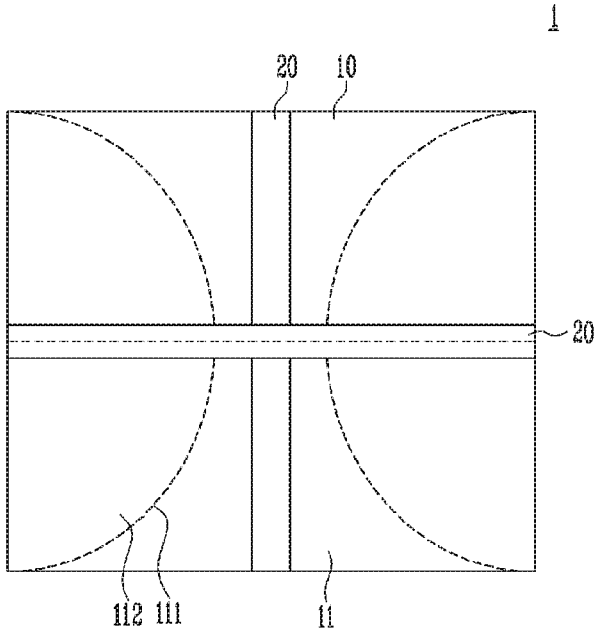

【Fig. 3】
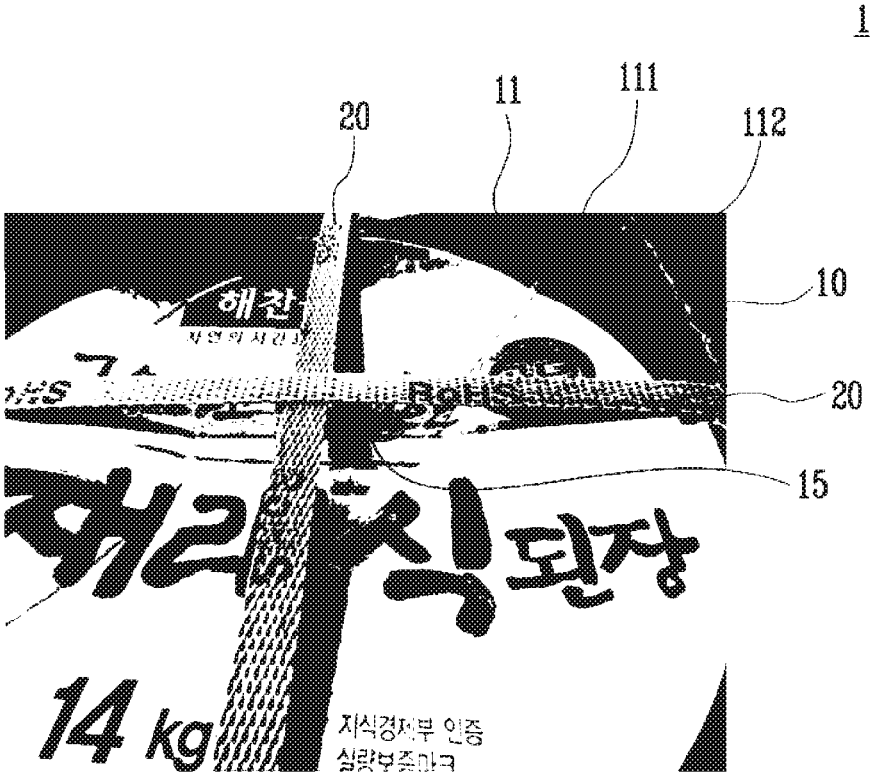
【Fig. 4】
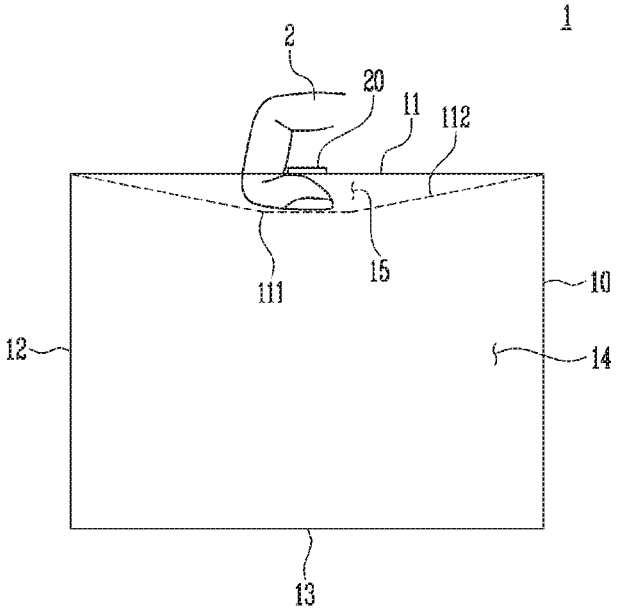

【Fig. 5】
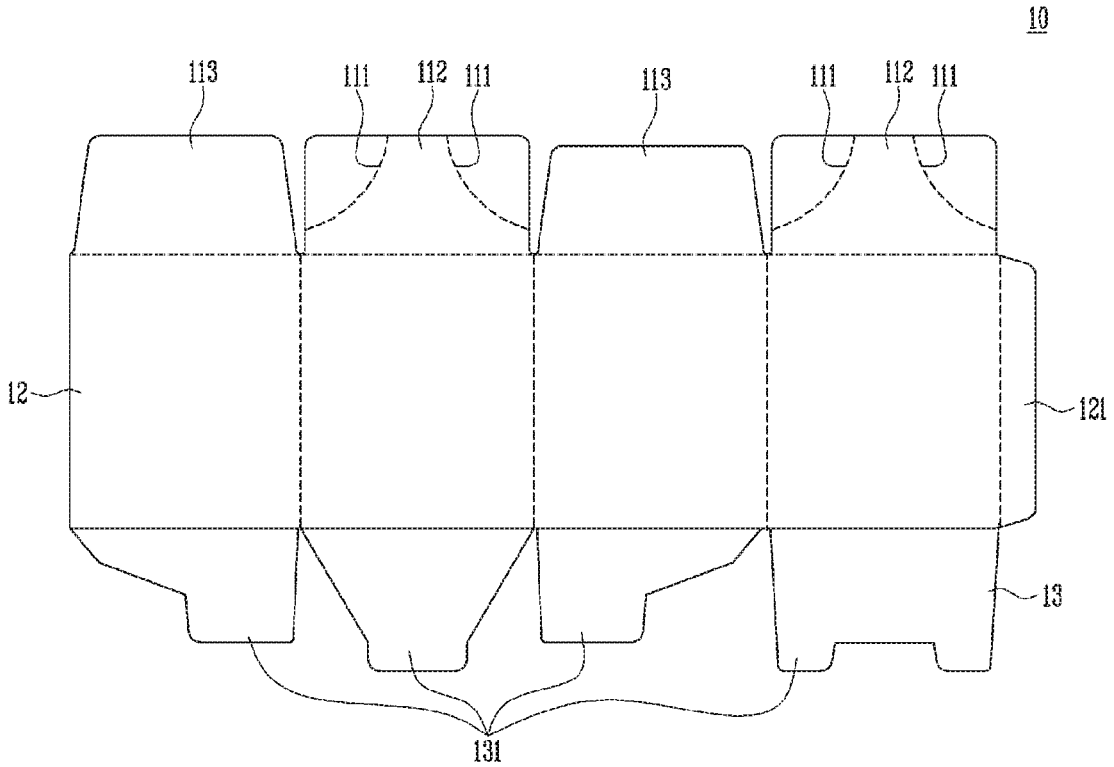

PACKAGING BOX

RELATED APPLICATIONS

This application is a 35 U.S.C. § 371 national phase application of PCT/KR2015/012793 (WO 2016/085273), filed on Nov. 26, 2015, entitled "Packaging box", which application claims the benefit of Korean Utility Model No. KR 20-2014-0008727, filed Nov. 27, 2014, which is incorporated herein by reference in its entirety.

TECHNICAL FIELD

The present invention relates to a packaging box, and more particularly, to a packaging box which can maintain sealability of an inner space and enables a user to easily hold a handle.

BACKGROUND ART

In general, in order to carry various things, such as fruits or crops, at once, a box of a cuboidal shape is utilized. The box is in the state that a lower surface and a side surface are sealed and an upper surface is open. After things are put in the box, the box may be carried after the upper surface is sealed.

In this instance, a user moves the box while holding the lower surface of the box with both hands after lifting up the box of the cuboidal shape. However, if the box is bulky or things put in the box are very heavy, it may cause great inconvenience in lifting the box as described above.

Therefore, conventionally, a box has a handle. For example, the box generally has a band, which is capable of maintaining sealability of the box and preventing separation of the contents and is capable of being utilized as a handle. In this instance, most of the bands are polypropylene bands because they must have elasticity, tensile force, corrosion resistance, thermal resistance, safety and environmental friendliness.

However, because the band is disposed wrapping the outer surface of the box, if the band is disposed tightly, the band presses against one side of the box. In this instance, because the user must put his or her finger between the band and the side of the box while forcibly opening a gap between the band and the side of the box and the user's finger may be pressed between the band and the side of the box if the band is lacking in elastic force, there is a danger of causing an accident.

In order to solve such a problem, an attempt to form a hole at one side of the box to insert the user's finger into the hole without using the band has been made. However, because the inner space of the box is communicated with the outside because of the hole, the contents stored in the box may be contaminated or get damaged.

DISCLOSURE

Technical Problem

Accordingly, the present invention has been made in view of the above-mentioned problems occurring in the prior art, and it is an object of the present invention to provide a packaging box, which includes an upper surface formed to be dented inwardly, a handle provided at the upper surface, and a finger insertion space naturally formed between the handle and the upper surface, thereby enabling a user to easily hold the handle through the finger insertion space.

It is another object of the present invention to provide a packaging box, of which the upper surface is dented inwardly while maintaining sealability even though the finger insertion space formed, thereby preventing foreign contaminant matters from infiltrating into the contents stored in the box.

Technical Solution

To accomplish the above object, according to the present invention, there is provided a packaging box including: a main body having at least an upper surface and an inner space; and a handle disposed on the upper surface of the main body, wherein the upper surface is disposed to be dented inwardly so as to be apart from the handle.

In detail, the upper surface is dented inwardly while sealing the inner space of the main body.

Moreover, the handle has a band form to surround the main body.

Furthermore, the upper surface includes a pair of foldable parts respectively having folding lines.

Additionally, the upper surface further includes a connection part for connecting the foldable parts with each other.

In addition, the folding lines are bilaterally symmetric and are disposed to be collected from the outer part of the upper surface to the middle part of the upper surface.

Furthermore, the main body includes a side surface extending downwardly from the upper surface, and a lower surface disposed at the bottom of the side surface.

Advantageous Effects

As described above, the packaging box according to an embodiment of the present invention has the folding line formed on the upper surface so as to make the upper surface dented inwardly by the user's pressing and make the upper surface and the handle spaced apart from each other such that the user can easily insert his or her finger therebetween, thereby remarkably improving user convenience.

Moreover, the packaging box according to an embodiment of the present invention may sufficiently shield the inner space from the outside because the upper surface can maintain sealing force when the upper surface is dented in order to form the finger insertion space, thereby effectively preventing the inflow of contaminants so as to maximize user satisfaction.

DESCRIPTION OF DRAWINGS

FIGS. 1 and 2 are top views of a packaging box according to a preferred embodiment of the present invention.

FIG. 3 is a perspective view of the packaging box according to the preferred embodiment of the present invention.

FIG. 4 is a side sectional view of the packaging box.

FIG. 5 is a planar figure of the packaging box.

MODE FOR INVENTION

The above and other objects, features and other advantages of the present invention will be more clearly understood from the following detailed description when taken in conjunction with the accompanying drawings. In the following description, the same elements will be designated by the same reference numerals although they are shown in different drawings. Further, in the following description of the present invention, a detailed description of known functions and configurations incorporated herein will be omitted when it may make the subject matter of the present invention rather unclear.

Hereinafter, exemplary embodiments of the present invention will be described in detail with reference to the accompanying drawings.

FIGS. 1 and 2 are top views of a packaging box according to a preferred embodiment of the present invention, FIG. 3 is a perspective view of the packaging box according to the preferred embodiment of the present invention, and FIG. 4 is a side sectional view of the packaging box. In this instance, FIG. 1 illustrates a state of the packaging box before an upper surface 11 is dented, and FIG. 2 illustrates a state of the packaging box after the upper surface 11 is dented.

FIG. 5 is a planar figure of the packaging box.

Referring to FIGS. 1 to 5, the packaging box 1 according to the preferred embodiment of the present invention includes a main body 10 and a handle 20.

The main body 10 includes at least an upper surface 11 and has an inner space. The main body 10 may include not only the upper surface 11 but also a side surface 12 and a lower surface 13, and the side surface 12 extends downwardly from the upper surface 11 and the lower surface 13 is disposed at the bottom of the side surface 12.

Therefore, the main body 10 may be formed in a cuboid and may store various things in the inner space formed therein. In this instance, the things stored in the inner space of the main body 10 are not restricted in forms or kinds thereof.

Of course, besides the main body 10 may have one of various shapes, such as a cuboid, an octagonal pillar, a cylinder, a sphere and so on. In case of the main body 10 of a spherical shape, the upper surface 11 may be formed in a curved form, and in this instance, the handle 20 may be disposed to get, in close contact with at least, a part of the upper surface 11.

The main body 10 may be made of a material like paper or other various materials, such as plastic or metal. Preferably, the main body 10 is made of a material which is not torn or broken even though it is folded along a folding line 111, which will be described later.

The upper surface 11 of the main body 10 may be disposed to be dented inwardly. The upper surface 11 has the handle 20, and the handle 20 is disposed to get in close contact with the upper surface 11. When the upper surface 11 is dented inwardly, the upper surface 11 may be spaced apart from the handle 20.

In this instance, a space between the upper surface 11 and the handle 20 may be defined as a finger insertion space 15. A user grasps the handle 20 to easily lift up the packaging box 1 after putting his or her finger 2 into the finger insertion space 15 formed between the dented upper surface 11 and the handle 20.

The upper surface 11 is dented in the direction to be apart from the handle 20 and may be dented downwardly as seen in the FIG. 4. In this instance, the upper surface 11 may be dented inwardly while sealing the inner space 14 of the main body 10. That is, the upper surface 11 is not torn or does not form any hole while being dented. For this, the upper surface 11 has a folding line 111 and the main body 10 is made of a foldable material.

Therefore, even though the upper surface 11 is dented, the packaging box may minimize infiltration of contaminants into the inner space 14 from the outside. As an example, when foods such as fruits are stored in the inner space 14, the packaging box allows the user to use the handle 20 while preventing penetration of bugs from the outside.

The upper surface 11 has a foldable part 112 and connection part 113. As shown in FIG. 5, when a plurality of the upper surfaces 11 overlap one another to seal the upper part of the inner space 14. In detail, the upper surface 11 includes a pair of foldable parts 112 and a pair of connection parts 113.

In this instance, the foldable parts 112 may be arranged on the connection parts 113 by intersection, and each of the foldable parts 112 has folding lines 111. The folding lines 111 can maintain a fixed form even though the upper surface 111 is dented inwardly so as to prevent the contents stored in the inner space 14 from getting damaged by the upper surface 11 crushed unnecessarily inwardly.

One of the foldable parts 112 may have a part of the folding line 111, and in this instance, the folding line 111 disposed on the foldable part 112 may be varied depending on the general shape of the folding line 111.

As an example, if the folding line 111 is a hyperbolic curve, the folding line 111 formed on one foldable part 112 may be a curved line. If the folding line 111 is in an X-shaped form or in a symmetrically trapezoidal form, the folding line 111 formed on the foldable part 112 may be a straight line or a straight line after being bent.

The folding line 111 may be a hyperbolic curve and nave a convex form at the middle part of the upper surface 11. Therefore, when the user presses the upper surface 11, the foldable part 112 may be naturally folded. Of course, the folding line 111 may not be the hyperbolic curve but be formed in a diagonal line on the upper surface 11. That is, the folding line 111 may have any form if it can make the upper surface 11 to be dented uniformly.

As an example, the folding line 111 may be formed in a bilaterally symmetric form to be collected from the outer part to the central part of the upper surface 11. Besides the hyperbolic form or the X-shaped form, the folding line 111 may have one of various forms, such as a symmetrically trapezoidal form.

The connection part 113 and the foldable part 112 are in surface contact with each other and may be adhered to each other by glue. Alternatively, the connection part 113 and the foldable part 112 may be disposed to simply get in surface contact with each other without using glue so that the foldable part 112 slides along the side of the connection part 113 while being folded along the folding line 111.

The connection part 113 may not have the folding line 111. Of course, the connection part 113 may have the folding line 111 formed at the position corresponding to the area where the folding line is formed. However, the folding direction of the connection part 113 may be different from the folding direction of the foldable part 112, and the folding line 111 which may be formed on the connection part 113 may have a form different from the folding line 111 formed on the foldable part 112.

Of course, the upper surface 11 may have only the foldable part 112, but in this instance, in order to tightly seal the upper surface 11, the foldable parts 112 are arranged to be overlapped with one another. However, the packaging box according to the embodiment of the present invention can sufficiently maintain sealing force of the upper surface 11 when the foldable part 112 is folded due to the connection part 113.

If the main body 10 is formed in a cuboidal shape, four side surfaces 12 may be disposed on the main body 10. Referring to FIG. 5, four side surfaces 12 are connected with one another in one direction to form four sides, and junction parts 131 for connecting one side 12 to another neighboring side 12 may be disposed at an end.

The junction parts 131 may have an adhesive, and adhesive surfaces of the junction parts 131 are adhered onto the side surface 12 having the junction part 131 and the neighboring side surface 12 so that the four side surfaces 12 may form the periphery of the main body 10. Alternatively, the junction parts 131 are arranged to overlap the side surface 12, and may be attached to the side surface 12 by various fixing means, such as a stapler.

At least three side surfaces 12 are disposed to form the inner space 14, and the junction parts 131 may be disposed at one side. One junction part 131 may be disposed at one side or two junction parts 131 may be disposed at both sides.

As shown in FIG. 5, the side surface 12 may be formed when a plurality of the surfaces are folded and connected with one another by the junction parts 131. Besides the above, the side surface may be formed when a plurality of the surfaces which are formed individually are connected with each other by the junction parts 131. That is, in this embodiment, the formation structure of the side surface 12 is not restricted.

The side surface 12 may be a flat surface or a curved surface, and it may be determined in various ways according to shapes of the main body 10. The side surface 12 has the form to surround the inner space 14 while connecting the upper surface 11 and the lower surface 13.

The side surface 12 may be made of a flexible material because the cross-section area of the upper surface 11 may be reduced when the upper surface 11 is dented inwardly. That is, if the upper surface 11 is dented inwardly, because the cross-section area of the upper surface 11 is reduced but the cross-section area of the lower surface 13 is maintained uniformly, the side surface 12 may be bent inwardly from the bottom to the top.

The lower surface 13 is on the opposite side of the upper surface 11 and seals the inner space 14 together with the upper surface 11 and the side surface 12. As shown in FIG. 5, the lower surface 13 may have four wing parts 131, and each of the wing parts 131 may be formed to extend to each side surface 12.

In this instance, the wing parts 131 are disposed to be folded inwardly from the side surfaces 12. Because the structure and method of forming the lower surface 13 while being folded are similar to those of widely known boxes, detailed description thereof will be omitted.

The lower surface 13 may be formed by assembly of the wing parts 131 or may be formed in a flat surface. Namely, the lower surface 13 may be formed in a flat surface and may be connected to the side surface 12 by various methods, such as adhesion or assembly.

As described above, because the inner space 14 is formed by the upper surface 11, the side surfaces 12 and the lower surface 13 and the upper surface 11 is dented inwardly in order to allow the user to easily grasp the handle 20 formed on the upper surface 11, the packaging box according to the embodiment of the present invention can remarkably improve user convenience.

The handle 20 is disposed on the upper surface 11 of the main body 10. The handle 20 may be disposed to get in close contact with the upper surface 11 of the main body 10 and the main body 10 may have a band form to surround the main body 10. In this instance, a plurality of the handles 20 are disposed to intersect each other on the upper surface 11. The handle 20 may surround the main body 10 such that there is little or no gap between the handle 20 and the upper surface 11. In this instance, the user may feel inconvenient because forcibly opening a gap between the upper surface 11 and the handle 20 and putting his or her finger into the gap in order to grasp the handle 20, but the packaging box according to the embodiment of the present invention can solve the above problem because the upper surface 11 is dented.

The handle 20 may have ring shape which surrounds the lower surface 13, two of the side surfaces 12 and the upper surface 11 or a curved line form disposed to surround the surfaces except the lower surface 13 or except the lower surface 13 and the side surfaces 12. The handle 20 may adopt one of various forms and may be disposed to get in close contact with the upper surface 11.

The handle 20 is disposed to surround the lower surface 13 and to be located on the upper surface 11. In case that there are four side surfaces 12, the handle 20 is disposed to surround all of the side surfaces 12 to support the load of the contents stored in the inner space 14 of the packaging box 1.

As described above, even though the handle 20 is disposed to get in close contact with the upper surface 11, the user can grasp the handle 20 easily because the upper surface 11 is disposed to be dented inwardly, and the packaging box can prevent deterioration in merchantability of the contents because the upper surface 11 is dented while maintaining sealability of the inner space 14.

Although exemplary embodiments of the present invention have been disclosed for illustrative purposes, it will be appreciated that the present invention is not limited thereto, and those skilled in the art will appreciate that various modifications, additions and substitutions are possible, without departing from the scope and spirit of the invention.

Accordingly, any and all modifications, variations or equivalent arrangements should be considered to be within the scope of the invention, and the detailed scope of the invention will be disclosed by the accompanying claims.

DESCRIPTION OF THE REFERENCE NUMERALS IN THE DRAWINGS

1: packaging box
2: finger
10: main body
11: upper surface
111: folding line
112: foldable part
113: connection part
12: side surface
121: junction part
13: lower surface
131: wing part
14: inner space
15: finger insertion space
20: handle

The invention claimed is:

1. A packaging box comprising:

a main body having at least an upper surface and an inner space; and a handle having a band form and installed on at least the upper surface of the main body, wherein the upper surface comprises;

a pair of foldable parts, each foldable part being separate from the handle, and each foldable part being separated from the other by a centerline traversing a center of the upper surface, the folding parts respectively comprising folding lines; and a connection part connecting the pair of foldable parts to each other and overlapping with the pair of foldable parts by surface-contacting lower surfaces of the pair of foldable parts;

wherein, as the pair of foldable parts are dented by folding along the folding lines and the connection part stays overlapped with the pair of foldable parts while the upper surface is dented inwardly, the pair of foldable parts are dented inwardly without separating from each other and thus an opening is not created at the pair of foldable parts, and thereby the upper surface is set apart from the handle, and a finger insertion space is formed between the upper surface and the handle, and wherein the folding lines on each of the pair of foldable parts comprises at least a bilaterally symmetric pair of folding lines extending to a middle part of the upper surface from positions adjacent to each corner of the upper surface, and wherein each foldable part is disposed to be folded from an outer part of the upper surface to the centerline traversing the center of the upper surface.

2. The packaging box according to claim 1, wherein the main body comprises:

a side surface extending downwardly from the upper surface; and a lower surface disposed at the bottom of the side surface.

* * * * *